US007906754B2

(12) United States Patent
Shimoi et al.

(10) Patent No.: US 7,906,754 B2
(45) Date of Patent: Mar. 15, 2011

(54) PHOTOMULTIPLIER TUBE AND RADIATION DETECTING DEVICE

(75) Inventors: Hideki Shimoi, Hamamatsu (JP); Kazuhiro Hara, Hamamatsu (JP); Hiroyuki Kyushima, Hamamatsu (JP)

(73) Assignee: Hamamatsu Photonics K.K., Hamamatsu-shi (JP)

( * ) Notice: Subject to any disclaimer, the term of this patent is extended or adjusted under 35 U.S.C. 154(b) by 401 days.

(21) Appl. No.: 12/225,412

(22) PCT Filed: Mar. 7, 2007

(86) PCT No.: PCT/JP2007/054451

§ 371 (c)(1), (2), (4) Date: Sep. 22, 2008

(87) PCT Pub. No.: WO2007/111103

PCT Pub. Date: Oct. 4, 2007

(65) Prior Publication Data

US 2009/0200940 A1 Aug. 13, 2009

(30) Foreign Application Priority Data

Mar. 24, 2006 (JP) ..... 2006-081996

(51) Int. Cl.
*H01J 40/14* (2006.01)
*H01J 31/50* (2006.01)

(52) U.S. Cl. ..... 250/214 VT; 250/207; 250/361 R; 313/532; 313/103 R

(58) Field of Classification Search ..... 250/214 VT, 250/207, 361 R, 366, 370.11; 313/532–535, 313/103 R, 103 CM, 105 R, 105 CM, 542
See application file for complete search history.

(56) References Cited

U.S. PATENT DOCUMENTS

| | | | | |
|---|---|---|---|---|
| 5,637,959 | A | 6/1997 | Kyushima et al. | |
| 5,789,861 | A | 8/1998 | Kyushima et al. | |
| 5,917,281 | A | 6/1999 | Shimoi et al. | |
| 7,238,928 | B2 * | 7/2007 | Shimoi et al. | 250/214 VT |
| 7,838,810 | B2 * | 11/2010 | Shimoi et al. | 250/214 VT |
| 2006/0091318 | A1 | 5/2006 | Shimoi et al. | |
| 2006/0138395 | A1 | 6/2006 | Kohno et al. | |

FOREIGN PATENT DOCUMENTS

| | | |
|---|---|---|
| JP | A-06-310085 | 11/1994 |
| JP | A-06-314552 | 11/1994 |
| JP | A-08-064168 | 3/1996 |
| JP | A-09-306416 | 11/1997 |
| JP | A-11-003677 | 1/1999 |
| JP | A-2003-338260 | 11/2003 |
| JP | A-2006-127984 | 5/2006 |

* cited by examiner

*Primary Examiner* — Kevin Pyo
(74) *Attorney, Agent, or Firm* — Oliff & Berridge, PLC

(57) ABSTRACT

A vacuum vessel (18) is configured by hermetically joining a faceplate (13) with one end of a side tube (15) and hermetically joining a stem (50) with another end via a ring-shaped side tube (37). Within the vacuum vessel (18), a focus electrode (17), dynodes (Dy1-Dy9), an anode (25), and a dynode (Dy10) are arranged from the side of a photocathode (14) provided to the faceplate (13). The dynode (Dy10) is supported on spacers (33) and a positioning protrusion (31) provided on the stem (50). The anode (25) is placed on support members (21). The focus electrode (17), the dynodes (Dy1-Dy9), and the anode (25) are stacked with inter-layer members (23) interposed therebetween, the inter-layer members (23) being located coaxially with the support members (21), to ensure high anti-vibration performance. Because the anode (25) and the dynode (Dy10) have no insulating body therebetween, light emission is suppressed and noises can be reduced.

10 Claims, 7 Drawing Sheets

PHOTOMULTIPLIER TUBE AND RADIATION DETECTING DEVICE

TECHNICAL FIELD

The present invention relates to a photomultiplier tube and a radiation detecting device.

BACKGROUND ART

Conventionally, in a photomultiplier tube having a reflection-type final-stage dynode, electrons emitted from a photocathode provided at one side of a vacuum vessel are multiplied by an electrode layer section including a plurality of dynodes in a layer arrangement, the multiplied electrons are further multiplied by the reflection-type final-stage dynode in a reflection direction, and the electrons are detected by an anode that is provided at the photocathode side of the reflection-type final-stage dynode. In such a photomultiplier tube, insulators are inserted between each of the dynodes and the anode, and the dynodes and the anode are stacked in a layer arrangement with predetermined spaces (for example, refer to patent document 1). In another example, each of dynodes and an anode is connected to a stem pin that supplies each of the dynodes and the anode with an electric potential (for example, refer to patent documents 2 and 3).

Patent document 1: Japanese Patent Application Publication No. H6-310085 (page 3, FIG. 4)

Patent document 2: Japanese Patent Application Publication No. H11-3677 (page 3, FIG. 1)

Patent document 3: Japanese Patent Application Publication No. 2003-338260 (pages 2-5, FIG. 3)

DISCLOSURE OF THE INVENTION

Problems to be Solved by the Invention

Because the above-described photomultiplier tubes have a layered structure where each electrode is stacked in a layer arrangement, it is desired that anti-vibration performance is improved and that noises in detected signals are reduced.

In view of the foregoing, it is an object of the present invention to provide a photomultiplier tube and a radiation detecting device provided with the same that can improve anti-vibration performance and that can reduce noises.

Method for Solving the Problems

In order to attain the above objects, the present invention provides a photomultiplier tube including: a vacuum vessel having a faceplate constituting one end and a stem constituting another end; a photocathode that converts incident light incident through the faceplate to electrons; an electron multiplying section that multiplies the electrons emitted from the photocathode; and an electron detecting section that transmits output signals in response to the electrons multiplied by the electron multiplying section, the photocathode, the electron multiplying section, and the electron detecting section being provided within the vacuum vessel, characterized in that the electron multiplying section includes dynodes stacked in a plurality of stages; the electron detecting section includes an anode that is arranged between a first dynode at a final stage and a second dynode at a stage before the first dynode; the stem is provided with a support means for placing the anode spaced apart from the first dynode, the support means being made of an electrically conductive material; and the anode and the second dynode are stacked with an inter-layer member made of an insulating material interposed therebetween.

With this configuration, the anode is placed on the support means of an insulating material, and no insulating body exists between the anode and the first dynode at the final stage. Hence, it is possible to prevent noises occurring from light emission generated by electrons colliding on an insulating body. Further, because the support means is provided, the anti-vibration performance can be improved.

At this time, it is preferable that a support protrusion made of an insulating material be provided on a surface of the stem confronting the photocathode, and that the first dynode be supported by the support protrusion.

With this configuration, because the first dynode that is the final stage dynode is supported by the support protrusion made of the insulating material, the positioning accuracy of each dynode in the electrode stacking direction can be increased. Further, because the creepage distances between the stem pin and the first dynode and between the side tube and the first dynode can be made long by the support protrusion, creeping discharge can be prevented.

In the above-described photomultiplier tube, it is preferable that the inter-layer member and the support means be arranged coaxially. With this configuration, the electrodes can be fixed by applying pressure in the electrode stacking direction, thereby improving the anti-vibration performance.

Here, it is preferable that the first dynode be formed with a fitting section that is fitted with the support protrusion. With this configuration, the positioning for arranging the first dynode is facilitated, and the positioning accuracy in the electrode surface can be improved.

Further, it is preferable that the first dynode be formed with a cutout, and that the support means pass through a region that is cut out by the cutout. In this way, by providing the cutout so that the support means and the first dynode do not contact, the support means and the first dynode can be separated electrically while the effective area of the first dynode is ensured.

A radiation detecting device having the above-described effects can be obtained by disposing, outside of the faceplate of any one of the above-described photomultiplier tubes, a scintillator that converts radiation to light and that outputs the light.

EFFECT OF THE INVENTION

According to the photomultiplier tube and the radiation detecting device of the present invention, a photomultiplier tube and a radiation detector with high anti-vibration performance and reduced noises can be provided.

DESCRIPTION OF REFERENCE NUMERALS

Figure 1:
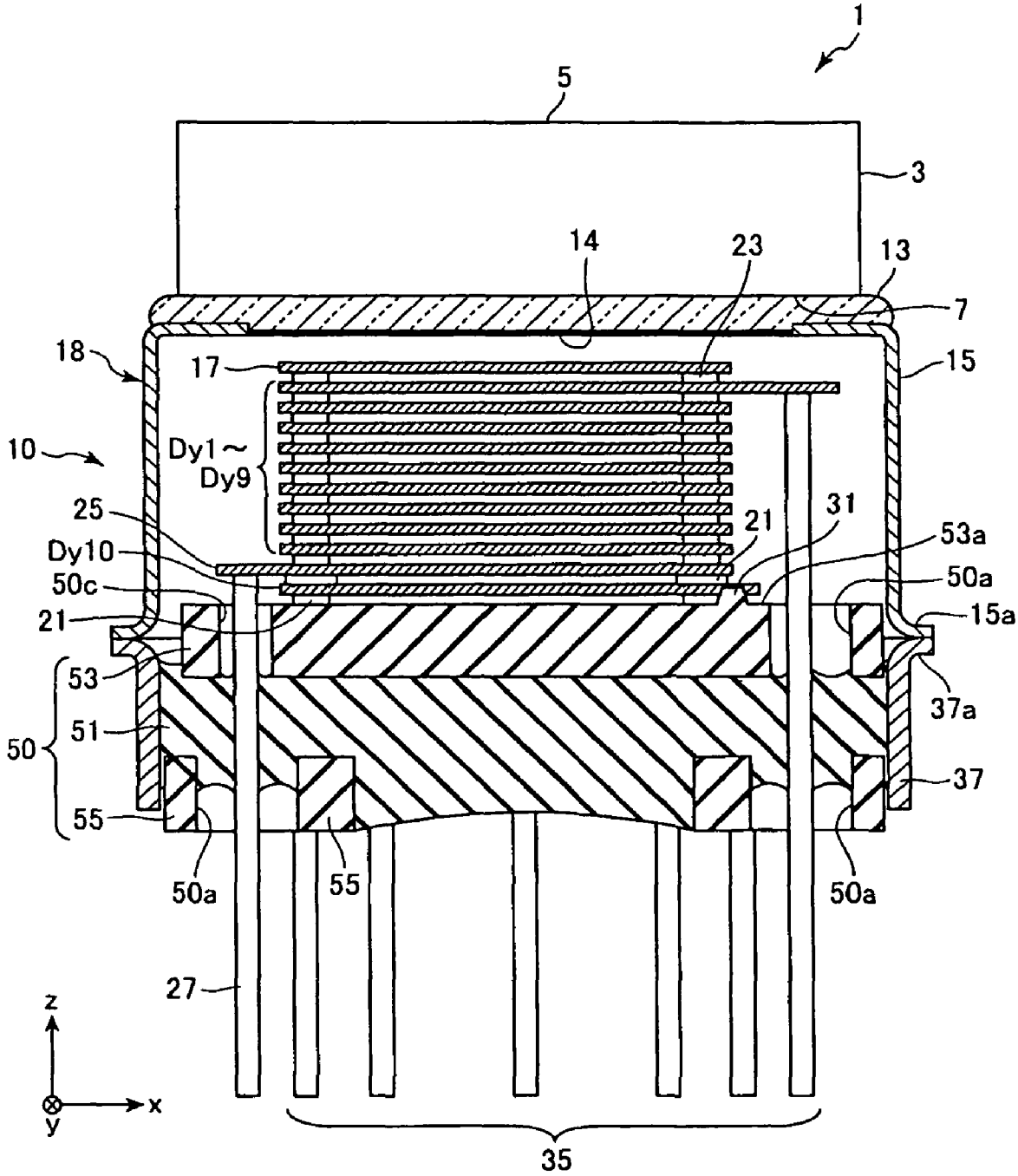
FIG. 1 is a schematic cross-sectional view of a radiation detecting device 1 according to an embodiment of the present invention.

1: radiation detecting device
3: scintillator
5: incident surface
7: output surface
10: photomultiplier tube
13: faceplate
14: photocathode
15: side tube
18: vacuum vessel
15*a*, 37*a*: flange section
21: support member
23: inter-layer member
27: anode pin
31: positioning protrusion
32: fitting section
33: spacer
35: stem pin
37: ring-shaped side tube
50: stem
50*a*: annular recess
51: base member
53: upper holding member
53*a*: upper surface
55: lower holding member

BEST MODE FOR CARRYING OUT THE INVENTION

Hereinafter, an embodiment of the present invention will be described while referring to the accompanying drawings. FIGS. 1 through 8 are drawings showing a radiation detecting device according to a first embodiment of the present invention. In each drawing, the substantially same parts are designated by the same reference numerals to avoid duplicating description. Note that, in the following description, the terms "upper", "lower", and the like are used based on a state shown in each drawing, for descriptive purposes.

Figure 2:
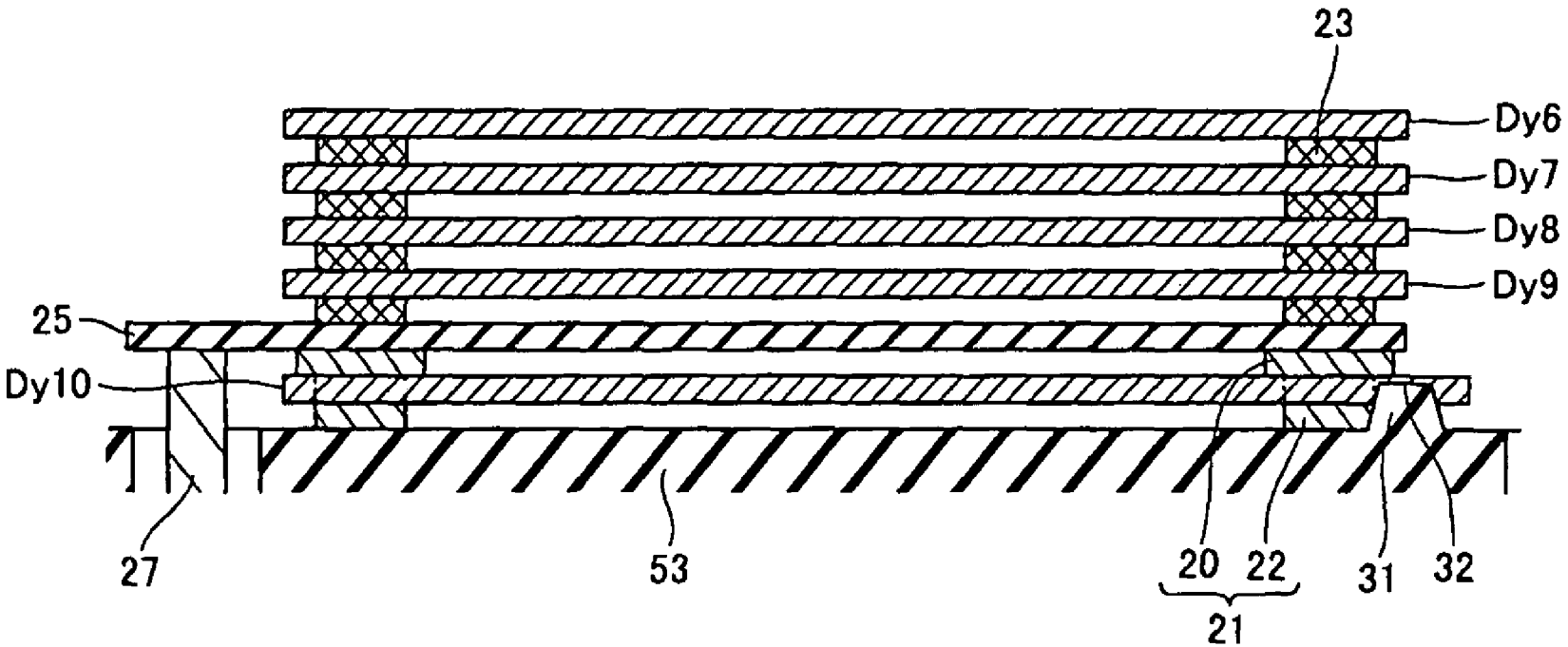
FIG. 2 is a partial enlarged view of a photomultiplier tube 10.

FIG. 1 is a schematic cross-sectional view of a radiation detecting device 1. FIG. 2 is a partial enlarged view of a photomultiplier tube 10. As shown in FIGS. 1 and 2, the radiation detecting device 1 includes a scintillator 3 that converts incident radiation to light and outputs the light, and the photomultiplier tube 10 that converts incident light to electrons, multiplies the electrons, and detects the electrons. The radiation detecting device 1 is a device that detects incident radiation and outputs signals. The photomultiplier tube 10 has a tubular shape with a substantially circular cross-section. The direction of the tube axis is defined as z-axis, the horizontal axis of FIG. 1 is defined as x-axis, and the axis perpendicular to the drawing surface of FIG. 1 is defined as y-axis.

The scintillator 3 includes an incident surface 5 at one side in the z-axis direction and an output surface 7 at the other side, and has a substantially cylindrical shape. Radiation incident on the incident surface 5 is converted to light inside the scintillator 3, and the light propagates within the scintillator 3 and is outputted from the output surface 7. The photomultiplier tube 10 is in facial contact with the output surface 7 of the scintillator 3. The central axis of the scintillator 3 and the tube axis of the photomultiplier tube 10 are approximately coaxial.

In the photomultiplier tube 10, a vacuum vessel 18 is configured by hermetically connecting and fixing a faceplate 13 that constitutes one end section in the z-axis direction, a stem 50 that constitutes the other end section, a ring-shaped side tube 37 provided at the periphery of the stem 50, and a side tube 15 having a tubular shape. A focus electrode 17, an electron multiplying section provided with a plurality of dynodes Dy1-Dy10, and an electron detecting section provided with an anode 25 that detects electrons and outputs signals are arranged within the vacuum vessel 18 of the photomultiplier tube 10.

The faceplate 13 is formed of glass, for example, and has a substantially circular plate shape. A photocathode 14 for converting incident light to electrons is provided at the inner side of the faceplate 13, that is, at the lower side in the z-axis direction. The photocathode 14 is formed by reaction of alkali metal vapor to preliminarily vapor-deposited antimony, for example. The photocathode 14 is provided on an approximately entire surface of the inner side of the faceplate 13. The photocathode 14 converts the light that is outputted from the scintillator 3 and that is incident on the faceplate 13 to electrons and emits the electrons.

The side tube 15 is formed of metal, for example, and has a substantially cylindrical shape. The side tube 15 constitutes a side surface of the photomultiplier tube 10. The side tube 15 is provided with the same electric potential as the photocathode 14. A flange section 15*a* is formed at the lower end section of the side tube 15. The ring-shaped side tube 37 provided at the lower side of the side tube 15 is formed of metal, for example, and has a substantially cylindrical shape. The ring-shaped side tube 37 is hermetically fixed to the stem 50, such that the ring-shaped side tube 37 surrounds the side of the stem 50. The upper end section of the ring-shaped side tube 37 constitutes a flange section 37*a*.

The faceplate 13 is fixed to one end section of the side tube 15, and the flange section 15*a* of the other end section is welded to the flange section 37*a* of the ring-shaped side tube 37, allowing the side tube 15 and the ring-shaped side tube 37 to be hermetically fixed to each other. Further, the ring-shaped side tube 37 and the stem 50 are hermetically fixed to each other to form the vacuum vessel 18.

As shown in FIG. 1, the stem 50 has a three-layer structure including a base member 51, an upper holding member 53 joined with the upper side of the base member 51 (the inner side of the vacuum vessel 18), and a lower holding member 55 joined with the lower side of the base member 51 (the outer side of the vacuum vessel 18).

The base member 51 is a circular-plate shaped member formed of insulating glass including kovar, for example, as primary component. The base member 51 takes on black color to such a degree that light from the lower side does not transmit to inside the vacuum vessel 18. The upper holding member 53 is a circular-plate shaped member formed of insulating glass having a melting point higher than the base member 51 by adding alumina powder, for example, to kovar. The upper holding member 53 is black colored so as to absorb light emission inside the vacuum vessel 18 efficiently. Like the upper holding member 53, the lower holding member 55 is a circular-plate shaped member formed of insulating glass having a melting point higher than the base member 51 by adding alumina powder, for example, to kovar. The lower holding member 55 takes on white color due to difference in composition of added alumina powder, and has higher physical strength than the base member 51 and the upper holding member 53.

Figure 3:
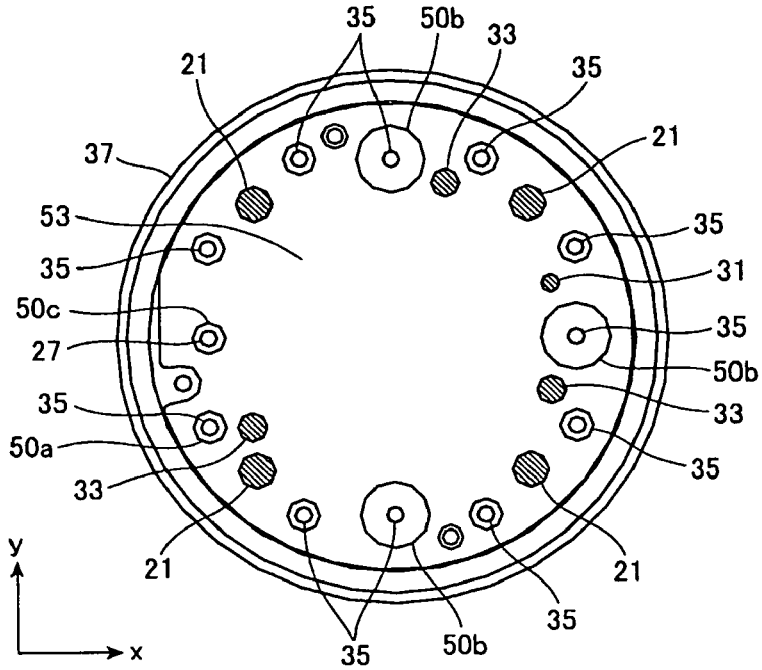
FIG. 3 is a schematic view of a stem 50 as viewed from the upper side in z-axis direction.

FIG. 3 is a schematic view of the stem 50 as viewed from the upper side in the z-axis direction. As shown in FIGS. 1 and 3, a plurality of stem pins 35 is hermetically inserted in the stem 50, and is arranged at substantially circular positions and spaced apart from each other in the circumferential direction. Hence, each of the base member 51, the upper holding member 53, and the lower holding member 55 constituting the stem 50 are formed with bores at positions where the stem pins 35 are inserted.

In the stem 50, the upper holding member 53 is in close contact with and joined with an upper surface of the base member 51, and the lower holding member 55 is in close contact with and joined with a lower surface of the base member 51. At this time, the base member 51, the upper holding member 53, and the lower holding member 55 are stacked and joined in a state where the axial centers of the plurality of bores formed in the base member 51, the upper holding member 53, and the lower holding member 55 are aligned with one another. Further, the bores of the upper holding member 53 and of the lower holding member 55 are formed to have a larger diameter than the openings of the base member 51. Each of the stem pins 35 extends through the bores formed in each of the base member 51, the upper holding member 53, and the lower holding member 55. An annular recess 50*a* is defined by the bore of the upper holding member 53 and the stem pin 35 extending through the bore. Another annular recess 50*a* is defined by the bore of the lower holding member 55 and the stem pin 35 extending through the bore. Each stem pin 35 is fusion-bonded at the annular recess 50*a* by fusing the base member 51.

Each stem pin 35 is formed of an electrically conductive material. Each stem pin 35 is inserted in the stem 50 so as to be fixed with the stem 50 as described above, extends upward in z-axis, and is connected to a predetermined electrode. The stem pins 35 are formed in lengths that correspond to the positions of electrodes to which the stem pins 35 are connected.

At least two (three in the present embodiment) among the above-described annular recesses 50*a* formed in each of the upper holding member 53 and the lower holding member 55 constitute annular recesses 50*b* having large diameters to allow a positioning jig to insert therethrough to the base member 51 during the assembly of the stem 50. Further, an annular recess 50*c* is defined by the bore of the upper holding member 53 and an anode pin 27 extending through the bore. The annular recess 50*c* is opened at an upper surface 53*a* of the upper holding member 53 (See FIG. 1). The anode pin 27 is fusion-bonded at the annular recess 50*c* by fusing the base member 51.

As shown in FIGS. 2 and 3, a positioning protrusion 31 is provided on the upper surface 53*a* of the upper holding member 53 inside the vacuum vessel 18, the positioning protrusion 31 being a support protrusion for supporting a dynode Dy10 thereon. The positioning protrusion 31 is formed of an insulating glass that is the same as the upper holding member 53. As shown in FIG. 2, the positioning protrusion 31 is fitted to a fitting section 32 formed on a lower surface of the dynode 10 confronting the stem 50. Further, a plurality of spacers 33 is provided on the upper surface 53*a*, the plurality of spacers 33 being support protrusions for placing the final-stage dynode Dy10 thereon. The spacers 33 are formed of an insulating glass that is the same as the upper holding member 53 of the stem 50. Three spacers 33 are provided in the present embodiment.

Further, a plurality of upwardly protruding support members 21 is provided on the upper surface 53*a*, serving as support means for placing the anode 25 thereon. In the present embodiment, the support members 21 are provided at four positions on the upper surface 53*a* that are spaced apart from each other by 90 degrees in the circumferential direction. The support member 21 is formed of an electrically conductive material, and includes a placing section 20 and a support section 22 as its cross-section is shown in FIG. 2, for example. The placing section 20 and the support section 22 have cylindrical shapes. The diameter of the placing section 20 is formed to be larger than the diameter of the support section 22. The placing section 20 and the support section 22 are connected coaxially. The support section 22 is arranged on the upper surface 53*a*. The placing section 20 is arranged to support the anode 25. Thus, the support member 21 enables the anode 25 to be supported stably.

Figure 4:
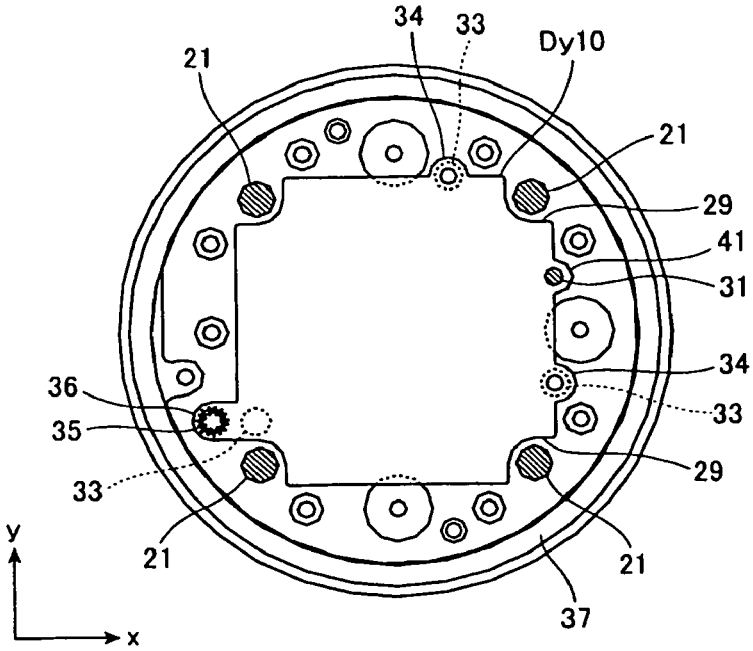
FIG. 4 is a schematic view of a dynode Dy10 as viewed from the upper side in the z-axis direction.

FIG. 4 is a schematic view of the dynode Dy10 as viewed from the upper side in the z-axis direction. As shown in FIG. 4, the dynode Dy10 is a first dynode that is provided spaced apart upward from the stem 50 in the z-axis direction and in confrontation with and in substantially parallel to the stem 50. The dynode Dy10 is a flat-plate shaped electrode having an electron multiplying function on its substantially entire surface. A protruding section 41 is formed at a portion of the dynode Dy10 that corresponds to the positioning protrusion 31, the protruding section 41 being capable of abutting the positioning protrusion 31. As described above, the fitting section 32 is provided on the surface of the protruding section 41 confronting the upper surface of the stem 50. The fitting section 32 is fitted with the positioning protrusion 31 and is joined with the positioning protrusion 31 by laser welding, thereby determining the position of the dynode Dy10 in the xy plane. Protruding sections 34 are formed at portions of the dynode Dy10 that correspond to the spacers 33, the protruding sections 34 being capable of abutting the spacers 33.

In this way, the positioning protrusion 31 is fitted with the fitting section 32 of the protruding section 41, and the protruding sections 34 are placed on the spacers 33, thereby supporting the entire dynode Dy10. Because of the configuration where the dynode Dy10 is placed on the positioning protrusion 31 and the spacers 33, the dynode Dy10 is positioned with respect to all of the x-axis, y-axis, and z-axis directions in a state spaced apart from the upper surface 53*a*.

Cutouts 29 are provided at the four corners of the dynode Dy10 for avoiding contact with the support members 21. A protruding section 36 is formed at a portion of the dynode Dy10 that corresponds to the stem pin 35. The dynode Dy10 is connected to the stem pin 35 and is supplied with a predetermined electric potential that is higher than an electric potential supplied with a dynode Dy9 and lower than an electric potential supplied with the anode 25.

Figure 5:
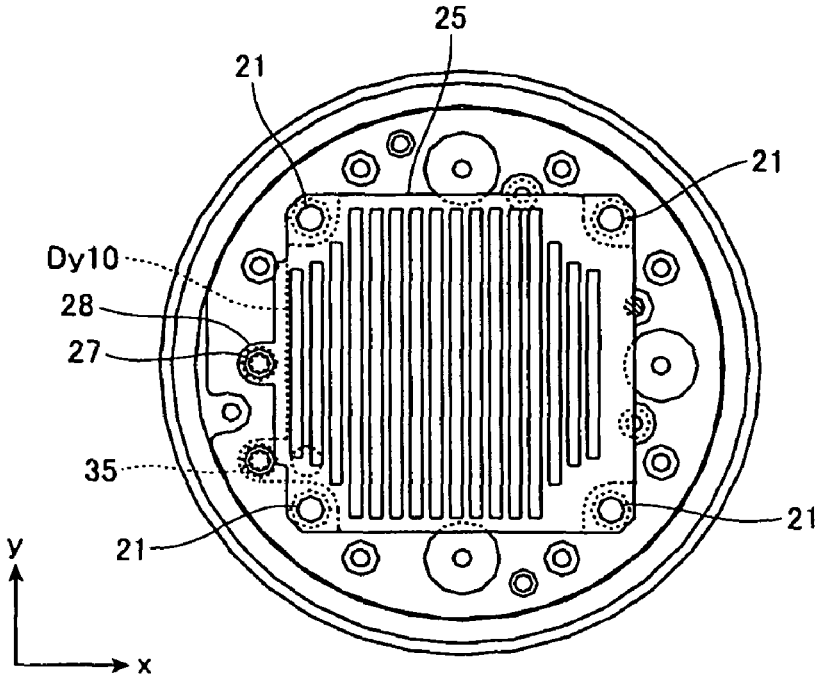
FIG. 5 is a schematic view of an anode 25 as viewed from the upper side in the z-axis direction.
Figure 6:
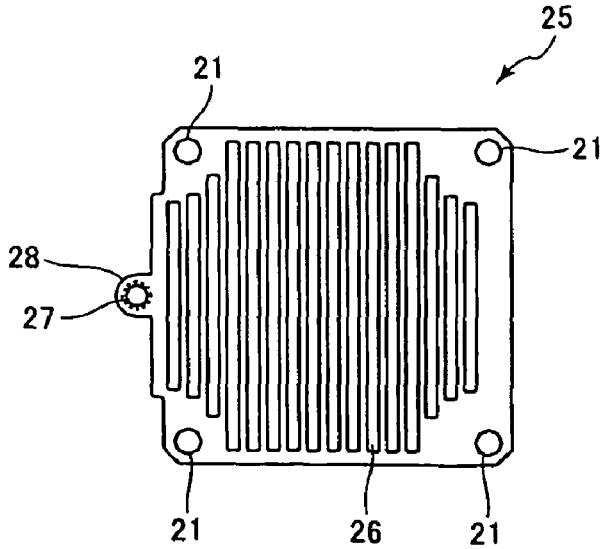
FIG. 6 is a plan view of the anode 25.

FIG. 5 is a schematic view of the anode 25 as viewed from the upper side in the z-axis direction. FIG. 6 is a plan view of the anode 25. As shown in FIGS. 5 and 6, the anode 25 is a substantially rectangular thin-plate electrode having a plurality of slits 26 extending in the y-axis direction for passing electrons therethrough. The anode 25 detects electrons emitted from the dynode Dy10. The anode 25 is arranged to substantially cover the dynode Dy10, and is placed on the placing sections 20 of the support members 21 at the four corners. Thus, the anode 25 is positioned with respect to the z-axis direction, and is arranged spaced apart upward from the dynode Dy10 in the z-axis direction and in confrontation with and in substantially parallel with the dynode Dy10. A protruding section 28 is formed at a portion of the anode 25 that corresponds to the anode pin 27, and is connected to the anode pin 27. The anode 25 is supplied with a predetermined electric potential and outputs detected signals.

Figure 7:
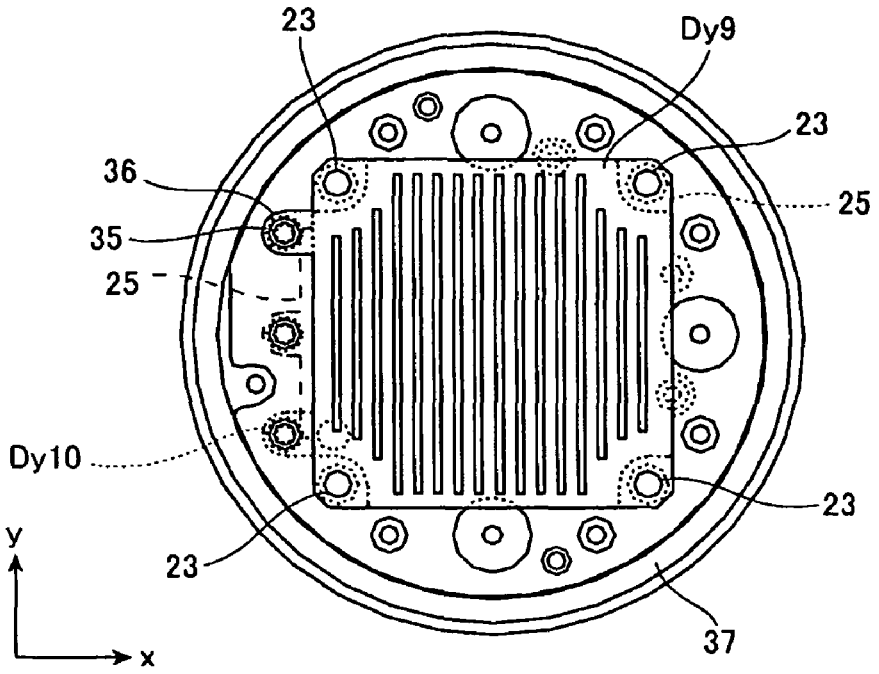
FIG. 7 is a schematic view of a dynode Dy9 as viewed from the upper side in the z-axis direction.
Figure 8:
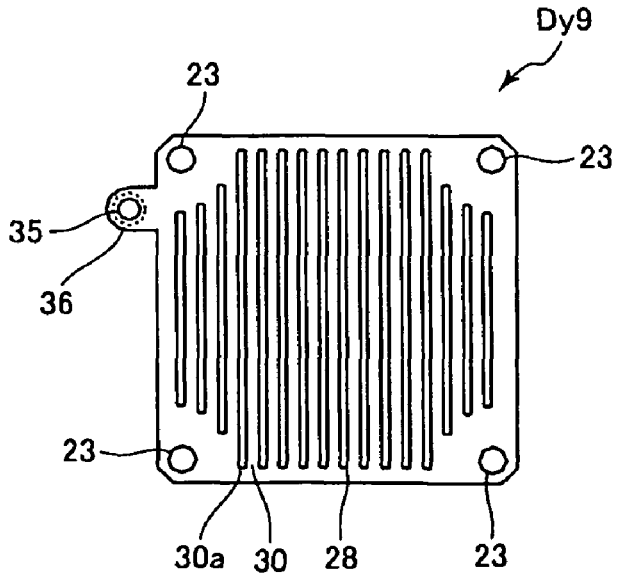
FIG. 8 is a plan view of the dynode Dy9.

FIG. 7 is a schematic view of the dynode Dy9 as viewed from the upper side in the z-axis direction. FIG. 8 is a plan view of the dynode Dy9. The slits 26 of the anode 25 are not shown in FIG. 7. As shown in FIGS. 7 and 8, the dynode Dy9 is a substantially rectangular thin-plate electrode. Electron multiplying pieces 30 extend spaced apart from each other and in parallel with each other, the electron multiplying pieces 30 having a predetermined shape (not shown) with concavities and convexities in a cross-section taken along the xz plane and an elongated shape in a cross-section taken along the yz plane, thereby forming slit-shaped electron multiplying openings 30*a* extending in the y-axis direction between the adjacent electron multiplying pieces 30.

The dynode Dy9 is a second dynode that is arranged to substantially cover the anode 25. The four corners are placed on inter-layer members 23, allowing the entirety of the dynode Dy9 to be supported. The dynode Dy9 is provided spaced apart upward from the anode 25 in the z-axis direction and in confrontation with and in substantially parallel with the anode 25. The inter-layer members 23 are insulating members arranged coaxially with the support members 21 in the z-axis direction. The inter-layer members 23 have spherical shapes or disk shapes with convex portions at the center of the top and bottom surfaces. Here, the dynode Dy9 may be provided with fitting sections that are dented in the z-axis direction for facilitating fixing with the inter-layer members 23. Further, the dynode Dy9 is formed with a protruding section 36. The stem pin 35 is connected to the protruding section 36, allowing the dynode Dy9 to be supplied with a predetermined electric potential.

The dynodes Dy8-Dy1 are thin-plate electrodes having electron multiplying pieces, in the same manner as the dynode Dy9. The dynodes Dy8-Dy1 are arranged sequentially from the direction of the stem 50 in a layered arrangement, and arranged spaced apart from each other and in confrontation with and in substantially parallel to each other with the inter-layer members 23 arranged coaxially with the support members 21 interposed between each of the dynodes. Further, the protruding section 36 is formed at a predetermined position of each of the dynodes Dy8-Dy1. The stem pin 35 is connected to the protruding section 36, thereby supplying a predetermined electric potential. Further, the dynodes Dy9-Dy1 are supplied by the stem pins 35 to electric potentials. The electric potentials supplied with the dynodes Dy9-Dy1 become sequentially higher from the photocathode 14 side toward the stem 50 side.

A focus electrode 17 is further arranged in confrontation with the photocathode 14. The inter-layer member 23 is interposed between the focus electrode 17 and the dynode Dy1. The focus electrode 17 is connected to the stem pin 35 and is supplied with the same electric potential as is supplied with the photocathode 14. The focus electrode 17 is a thin-plate electrode having a plurality of focus pieces that extend in the y-axis direction, where slit-shaped multiplying openings are formed between the adjacent focus pieces. The focus electrode 17 does not have an electron multiplying region. The focus electrode 17 converges electrons emitted from the photocathode 14 to be incident on the electron multiplying region of the dynode Dy1 efficiently.

With the radiation detecting device 1 according to the present embodiment having the above-described configuration, when radiation is incident on the incident surface 5 of the scintillator 3, light in response to the incident radiation is outputted to the output surface 7. When the light outputted by the scintillator 3 is incident on the faceplate 13 of the photomultiplier tube 10, the photocathode 14 emits electrons in response to the incident light. The focus electrode 17 provided in confrontation with the photocathode 14 converges the electrons emitted from the photocathode 14 to be incident on the dynode Dy1. The dynode Dy1 multiplies the incident electrons and emits the electrons to the lower stage dynode Dy2. The electrons multiplied sequentially by the dynodes Dy1-Dy9 in this way pass through the slits of the anode 25, and are further multiplied by the dynode Dy10 in the reflection direction to reach the anode 25. The anode 25 detects the reached electrons and outputs the electrons as signals to the outside through the anode pin 27.

As described above in details, according to the radiation detecting device 1 of the present embodiment, it is possible to detect radiation that is incident on the scintillator 3 and to output signals to the outside.

The emission of the electrons reflected and multiplied by the flat plate dynode Dy10 spreads wider, because these electrons multiplied by dynode Dy10 are the largest number among electrons multiplied by other dynodes. Hence, if an insulating body exists between the anode 25 and the dynode Dy10, there is possibility that electrons collide on the insulating body so as to emit light, and the light reaches the photocathode 14 and generates false signals (noises). In the photomultiplier tube 10 used for the above-described radiation detecting device 1, however, the anode 25 is placed on the support members 21 which are conductive material, and no insulating body exists between the anode 25 and the final-stage dynode Dy10. Thus, electrons can be prevented from colliding on an insulating body and emitting light to generate noises. Further, the anode 25 is placed on the placing section 20 constituting the support members 21, and the inter-layer members 23 are arranged coaxially in the z-axis direction with the support members 21, thereby supporting each electrode. Hence, each electrode can be fixed by applying pressure in the electrode stacking direction. Thus, the anti-vibration performance is improved, and the positioning accuracy in the electrode stacking direction is also improved.

Because the dynode Dy10 is placed on the positioning protrusion 31 as a support protrusion and the spacers 33, the positioning accuracy in the z-axis direction can be improved. Additionally, because the fitting section 32 is formed on the lower surface of the dynode Dy10 confronting the stem 50 to be fitted with the positioning protrusion 31, the positioning of the dynode Dy10 in the xy plane can be facilitated, thereby improving the positioning accuracy in the electrode surface (in the xy plane). Further, the positioning protrusion 31 ensures the creepage distances between the dynode Dy10 and each stem pin 35 and between the dynode Dy10 and the side tube 15 so that effects of preventing creeping discharge can be obtained.

Because the dynode Dy10 is provided with the cutouts 29 so as not to contact the support members 21, all the region of the dynode Dy10 can be used as an electron multiplying region. The support means 21 and the dynode Dy10 can be separated electrically, while the effective area of the dynode Dy10 is ensured.

Figure 9:
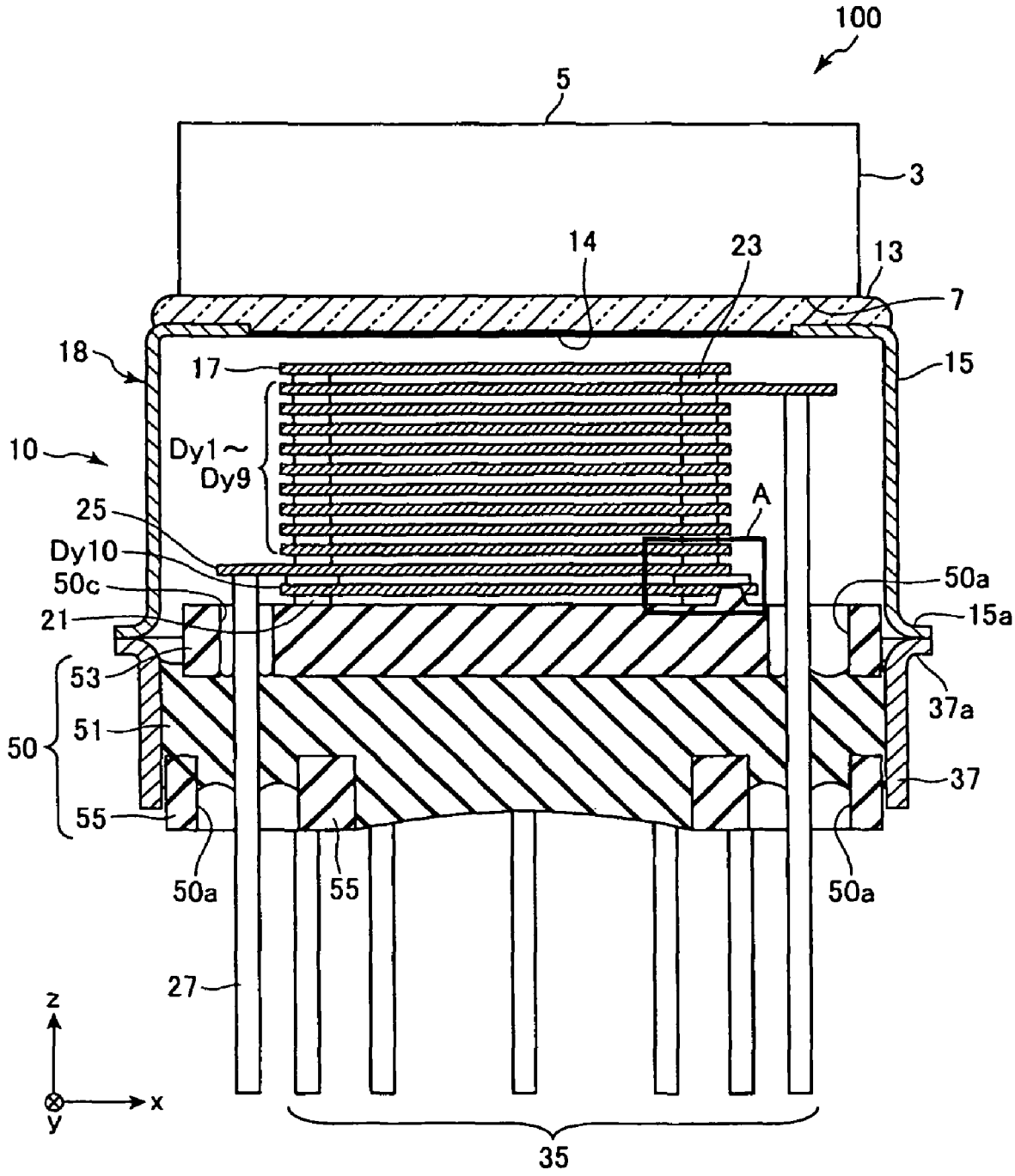
FIG. 9 is a schematic cross-sectional view of a radiation detecting device 100 according to a modification of the present invention.
Figure 10:
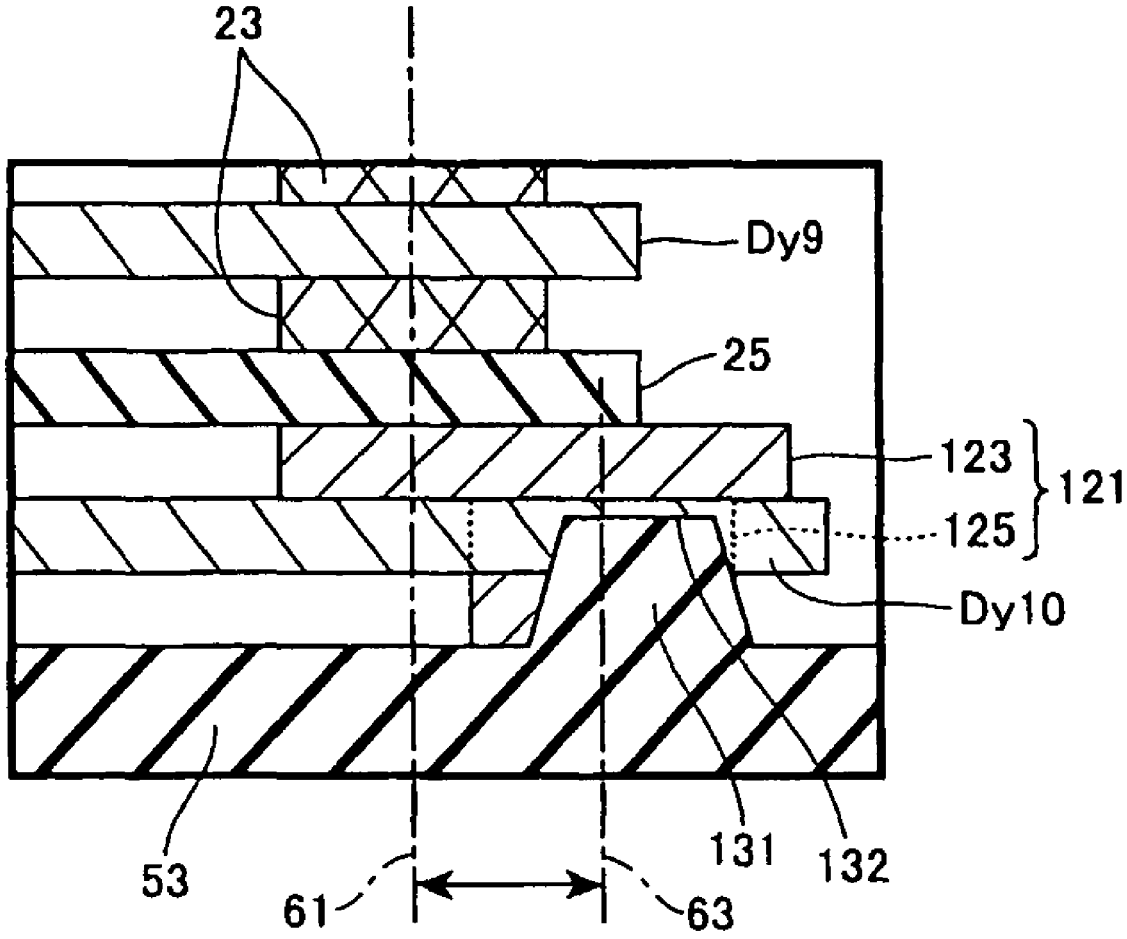
FIG. 10 is a partial enlarged view of FIG. 9.

Next, a modification will be described while referring to FIGS. 9 and 10. In the present modification, the substantially same parts as the above-described embodiment are designated by the same reference numerals to avoid duplicating description. FIG. 9 is a schematic cross-sectional view of a radiation detecting device 100 according to the modification. FIG. 10 is an enlarged view of a region A in FIG. 9.

In the present modification, as shown in FIGS. 9 and 10, the anode 25 is placed on and supported by a support member 121, instead of the support members 21 in the first embodiment. The support member 121 is configured by a placing section 123 and a support section 125. Both the placing section 123 and the support section 125 have cylindrical shapes, where the diameter of the placing section 123 is configured to be larger than the diameter of the support section 125. Further, the central axis of the support section 125 in the z-axis direction is an axis 63. The central axis of the placing section 123 is shifted toward the center of the photomultiplier tube 10 from the axis 63 of the support section 125.

Although the dynodes Dy1-Dy9 and the focus electrode 17 are stacked with the inter-layer members 23 interposed therebetween, an axis 61 of the inter-layer members 23 is not coincident with the axis 63 of the support member 121. A coaxial configuration is preferable in view of ensuring strength in the stacking direction. However, a non-coaxial configuration can be used as in the present modification, by changing the shape of the support member 121, especially, the strength and size of the placing section 123, and the length of the support section 125. Because the other configuration, operation, and effects are similar to the radiation detecting device 1 according to the first embodiment, description is omitted.

It would be apparent that the radiation detecting device according to the present invention is not limited to the above-described embodiments, and that various changes and modifications may be made therein within the scope of the subject matter of the present invention.

For example, although the configuration of the stem 50 is a three-layer structure including the upper holding member 53, the base member 51, and the lower holding member 55, other configurations may be used. The lower surface of the lower holding member 55 in the z-axis direction (the outer side of the vacuum vessel 18) protrudes downward from the lower end of the ring-shaped side tube 37. However, the fixing position of the stem 50 relative to the ring-shaped side tube 37 is not limited to the above-described configuration.

The shapes of the support members 21 and 121 are not limited to the above-described shapes, and may be other shapes such as polygonal columns, provided that the anode 25 can be placed thereon.

The shape of each of the dynodes Dy1-Dy10 is not limited to the above-described shape, and may be another shape such as a circle.

INDUSTRIAL APPLICABILITY

The radiation detecting device of the present invention is applicable to an image diagnostic apparatus for medical use.

The invention claimed is:

1. A photomultiplier tube comprising:

a vacuum vessel having a faceplate constituting one end and a stem constituting another end, the faceplate having an outer surface, the stem being provided with a support member made of an electrically conductive material;

a photocathode that converts incident light incident through the faceplate to electrons;

an electron multiplying section that multiplies the electrons emitted from the photocathode, the electron multiplying section including a plurality of dynodes stacked in a plurality of stages including a first dynode at a final stage and a second dynode at a penultimate stage;

an electron detecting section that detects the electrons multiplied by the electron multiplying section and outputs an electrical signal indicative of the detected electrons, the electron detecting section including an anode that is arranged between the first dynode and the second dynode and placed on the support member spaced apart from the first dynode; and an inter-layer member that is made of an electrically insulating material and interposed between the anode and the second dynode, wherein the photocathode, the electron multiplying section, and the inter-layer member are provided within the vacuum vessel.

2. The photomultiplier tube as claimed in claim 1, wherein a support protrusion made of an electrically insulating material is provided on a surface of the stem confronting the photocathode, and the first dynode is supported by the support protrusion.

3. The photomultiplier tube as claimed in claim 1, wherein the inter-layer member and the support means are arranged coaxially.

4. The photomultiplier tube as claimed in claim 2, wherein the first dynode is formed with a fitting section that is fitted with the support protrusion.

5. The photomultiplier tube as claimed in claim 1, wherein the first dynode is formed with a cutout, and the support member extends in a direction substantially perpendicular to the first dynode and passes by the cutout.

6. A radiation detecting device comprising:

a photomultiplier tube including:

a vacuum vessel having a faceplate constituting one end and a stem constituting another end, the faceplate having an outer surface, the stem being provided with a support member made of an electrically conductive material;

a photocathode that converts incident light incident through the faceplate to electrons;

an electron multiplying section that multiplies the electrons emitted from the photocathode, the electron multiplying section including a plurality of dynodes stacked in a plurality of stages including a first dynode at a final stage and a second dynode at a penultimate stage;

an electron detecting section that detects the electrons multiplied by the electron multiplying section and outputs an electrical signal indicative of the detected electrons, the electron detecting section including an anode that is arranged between the first dynode and the second dynode and placed on the support member spaced apart from the first dynode; and an inter-layer member that is made of an electrically insulating material and interposed between the anode and the second dynode, wherein the photocathode, the electron multiplying section, and the inter-layer member are provided within the vacuum vessel; and a scintillator disposed in facial contact with the outer surface of the faceplate of the photomultiplier tube, the scintillator converting radiation to light and outputting the incident light.

7. The photomultiplier tube as claimed in claim 6, wherein a support protrusion made of an electrically insulating material is provided on a surface of the stem confronting the photocathode, and the first dynode is supported by the support protrusion.

8. The photomultiplier tube as claimed in claim 6, wherein the inter-layer member and the support member are arranged coaxially.

9. The photomultiplier tube as claimed in claim 7, wherein the first dynode is formed with a fitting section that is fitted with the support protrusion.

10. The photomultiplier tube as claimed in claim 6, wherein the first dynode is formed with a cutout, and the support member extends in a direction substantially perpendicular to the first dynode and passes by the cutout.

* * * * *